US008579380B2

(12) United States Patent
Parrott

(10) Patent No.: US 8,579,380 B2
(45) Date of Patent: Nov. 12, 2013

(54) WATER SPRAY ASSEMBLY ETC

(75) Inventor: George Albert Parrott, Wakefield (GB)

(73) Assignee: Minnovation Limited (GB)

( * ) Notice: Subject to any disclaimer, the term of this patent is extended or adjusted under 35 U.S.C. 154(b) by 387 days.

(21) Appl. No.: 12/821,225

(22) Filed: Jun. 23, 2010

(65) Prior Publication Data

US 2011/0006587 A1 Jan. 13, 2011

(30) Foreign Application Priority Data

Jul. 13, 2009 (GB) ..... 0912116.1

(51) Int. Cl.
*E21C 35/187* (2006.01)

(52) U.S. Cl.
USPC ..... 299/81.3; 299/81.1; 239/390

(58) Field of Classification Search
USPC ..... 299/81.1, 81.3, 104, 111; 175/425; 239/200, 390
IPC ..... B05B 15/06; E21C 35/22,35/187
See application file for complete search history.

(56) References Cited

U.S. PATENT DOCUMENTS

| | | | | |
|---|---|---|---|---|
| 3,127,110 | A * | 3/1964 | Reynolds | 239/204 |
| 5,007,684 | A * | 4/1991 | Parrott | 299/81.3 |
| 5,378,048 | A * | 1/1995 | Parrott | 299/81.3 |
| 5,392,870 | A * | 2/1995 | Clapham et al. | 299/81.1 |
| 6,247,759 | B1 * | 6/2001 | Montgomery et al. | 299/81.3 |
| 6,631,855 | B2 * | 10/2003 | Huang | 239/526 |
| 6,758,529 | B2 * | 7/2004 | Parrott | 299/81.3 |

FOREIGN PATENT DOCUMENTS

| | | |
|---|---|---|
| GB | 2239822 A | 7/1991 |
| GB | 2246588 A | 2/1992 |
| GB | 2250455 A | 6/1992 |
| GB | 2353486 A | 2/2001 |

* cited by examiner

*Primary Examiner* — Benjamin Fiorello
(74) *Attorney, Agent, or Firm* — Hooker & Habib, P.C.

(57) ABSTRACT

A water spray assembly for replaceable location in a receiving bore of a pick box, which pick box is also adapted to receive a replaceable mineral cutter pick, is constructed from two components. One component is a spray body and the other component is a co-axial spray nozzle. The two components are releasably connected together by screw threads, whereby the spray assembly may either be removed from or inserted into, its receiving bore as a whole, or alternatively as individual components.

22 Claims, 5 Drawing Sheets

1
16
17
18
19
20
22
22A
22B
25
30
31
32
33
35
36

WATER SPRAY ASSEMBLY ETC

FIELD OF THE INVENTION

This invention relates to a water spray assembly and to a pick box provided with such a spray assembly.

BACKGROUND OF THE INVENTION

Pick boxes of rotary cutting heads or drums of mineral winning machines or tunnel driving machines are frequently fitted with screw-in water spray nozzles, particularly if coal mining is involved, for a variety of well established reasons. The propensity for damage to the nozzles has led to the adoption of so-called rear-entry spray nozzles, whereby the nozzle is screwed into, and out of its receiving bore, from the rear of the pick box.

Inevitably, in service conditions nozzle blockage and/or damage occurs, and whilst blockage of a few nozzles e.g. on a cutting head carrying 50-100 pick boxes and associated nozzles might be tolerated, modern mining machines monitor both water flow and pressure so that keeping the nozzles operational is critical to avoid automatic machine shut-down, and consequently nozzle removal, inspection, cleaning and/or replacement followed by replacement of a cleaned or new nozzle, in mine conditions is involved.

In addition, to achieve a desired spray pattern—usually a hollow or solid cone—the spray nozzle is a precision component and hence relatively expensive if replacement, and in particular multiple replacement, is required.

A basic object of the invention is the provision of an improved water spray assembly and a pick box incorporating such an assembly.

SUMMARY OF THE INVENTION

According to a first aspect of the invention there is provided a water spray assembly, for replaceable location in a receiving bore of a pick box, which pick box is also adapted to receive a replaceable mineral cutter pick, the spray assembly is constructed from two components, one component being a spray body and the other component being a co-axial spray nozzle, with the two components being releasably connected together by means of screw threads, characterised in that the spray nozzle is removable from, or insertable into, one end of its receiving bore without disturbing the spray body, and the spray body, with or without the spray nozzle, is removable from, or insertable into, the other end of the receiving bore.

According to a second aspect of the invention there is provided a pick box adapted to be secured to a rotary cutting head or shearer drum and provided with a bore in which is located a water spray assembly in accordance with the first aspect.

The two-component spray nozzle assembly in accordance with the invention provides the option of removal of the entire spray assembly, as a unit, from the rear of its receiving bore in the pick box, or alternatively removal of the spray nozzle only from the front of its receiving bore, with the spray body remaining in situ. It would of course be possible to remove the spray body only from the rear end of the bore but normally this component requires no maintenance or inspection and lasts the life of the associated pick box. Thus, when the spray nozzle becomes worn or damaged, only this component requires replacement and the spray body remains in situ, available for re-use.

In a first embodiment, the spray body is provided with an external thread adapted to be screwed into a portion of an internally tapped receiving bore of a pick box.

To permit the spray body to be screwed into, or out of, the receiving bore in the pick box, an end thereof, distal from the screw thread by which it is connectable to the spray nozzle, is provided with a hexagonal socket for engagement by an Allen key, although a diametrical slot might be provided for engagement by an ordinary screwdriver blade, or a Philips or Torx recess might be provided for engagement by a Philips or Torx screwdriver. Yet again, flats might be provided for engagement by a suitable tool, or a coaxial spigot e.g. of hexagonal profile might be provided, for engagement by a hexagonal drive socket.

The spray body terminates, at an end thereof, distal from the screw thread by which it is connectable to the spray nozzle, in an enlarged head or collar adapted, in use, to abut a portion of the pick box and thereby limit penetration of the water spray assembly into its receiving bore.

The spray body is provided, intermediate its ends, with a circumferential groove adapted to be in water flow communication with a water supply bore of the pick box, which bore is adapted to convey pressurized water from a supply source.

The spray body is provided with two resilient water sealing rings, one located each side of the circumferential groove, in a sealing ring receiving groove.

The spray body is provided with a gauze filter sleeve surrounding the circumferential groove.

The spray body is provided with an internal, water-receiving chamber to which water is conveyed by at least one inlet bore, from the circumferential groove.

The water receiving chamber is a bore, preferably a coaxial bore.

The at least one inlet bore is located at such an angle as to produce a swirl in the water supply.

The spray body terminates, at an end proximate to the screw thread by which it is connectable to the spray nozzle, in a sleeve, which is internally threaded, to receive a nose portion of the water spray nozzle, which is correspondingly externally threaded, whereby the two components may be attached to one another to form the water spray assembly, or separated from one another for removal, inspection, cleaning, re-fitting or replacement.

The water spray nozzle is also provided with a water receiving chamber in fluid flow communication with that of the water spray body.

The water receiving chamber of the spray nozzle is a bore, preferably a coaxial bore.

The water receiving chambers of both the spray body and the spray nozzle are of the same diameter.

The water receiving chamber of the water spray nozzle is provided with a discharge orifice appropriate to the water spray pattern required.

The water spray nozzle is provided, at its end that is distal from the screw thread by which it is connected to the spray body, with an enlarged head or collar which is externally grooved, between its ends, to receive a water sealing ring, the head or collar being adapted to enter the receiving bore, with the sealing ring resiliently engaging the receiving bore.

The enlarged head or collar of the water spray nozzle is of smaller diameter than the head or collar of the spray body, such that it may penetrate a portion, such as a counter-bored portion, of the receiving bore, and hence be protected within the receiving bore.

The enlarged head or collar of the water spray nozzle is provided with a hexagonal recess to be engaged by an Allen key, to enable the spray nozzle to make screwed connection with, or disconnection from, the spray body. Again, as with the spray body, various alternatives are possible such as flats or a Torx recess.

In the connected position, a terminal inner end of the spray nozzle abuts an annular, radial face of the spray body.

In a second embodiment, the water spray assembly is adapted to be retained in its receiving bore in a screwless manner, for which purpose the enlarged head or collar of the spray nozzle, together with the enlarged head or collar of the spray body, define abutment surfaces for location against or near to corresponding surfaces of the pick box.

This embodiment avoids the need to tap the receiving bore, and simplifies fitting and removal.

Although the arrangement could be such that both enlarged heads engage, and can be tightened against, surfaces of the pick box, the arrangement is such that the spray assembly can float, within limits, in the receiving bore.

The enlarged head or collar of the spray nozzle is the same diameter as that of the spray body, so that the spray assembly is balanced and the water pressure has a neutral effect on the assembly.

The receiving bore, adjacent its forward end is counterbored to define an annular shoulder for engagement by the enlarged head of the spray nozzle.

Otherwise, save for the absent external thread on the spray body, all the preferred or optional features of the first embodiment are present in the second embodiment.

Other objects and features of the invention will become apparent as the description proceeds, especially when taken in conjunction with the accompanying five drawing sheets illustrating multiple embodiments of the invention.

DESCRIPTION OF THE PREFERRED EMBODIMENTS

Figure 1:
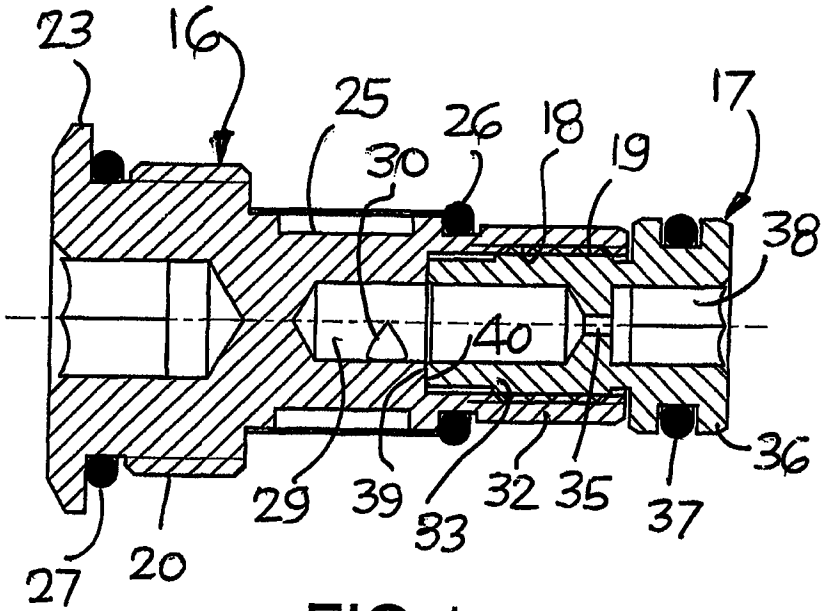
FIG. 1 is a longitudinal sectional view through the first embodiment of water spray assembly in accordance with the first aspect.

As shown in FIGS. 3, 4, 7 & 8 of the drawings a water spray assembly 1 located in a multi-diameter receiving bore 2 of a pick box 3 (also known as a tool holder or, in U.S. terminology, a block).

In turn the pick box 3 is provided with a multi-diameter bore 4 to replaceable sleeve 5 with an enlarged collar 6 at one end adapted to make annular seating contact with a portion of the pick box 3, and to limit the penetration of the sleeve 5 into the pick box 3. Releasably received in the sleeve 5 by a shank 7 is a point attack, numeral cutter pick 8 having, at approximately its mid length, an enlarged collar 9 to make annular seating contact with a portion of the collar 6 of the sleeve 5. A head 10 of the pick 8 is provided with a carbide tip 11. Recess 12 is provided in the pick box 3 for the insertion of a drift to engage end 13 of the pick 8, for manually levering the picks out of the sleeve 5 when pick changing is required. The pick box 3 is also provided with a bore 14 leading to the bore 2 housing the water spray assembly for the supply of pressurized water to the water spray assembly 1 to emit a conical spray 15 to a zone slightly behind the pick head 10 and tip 11, for well understood reasons.

The above is a widely used, industry standard arrangement.

Figure 2:
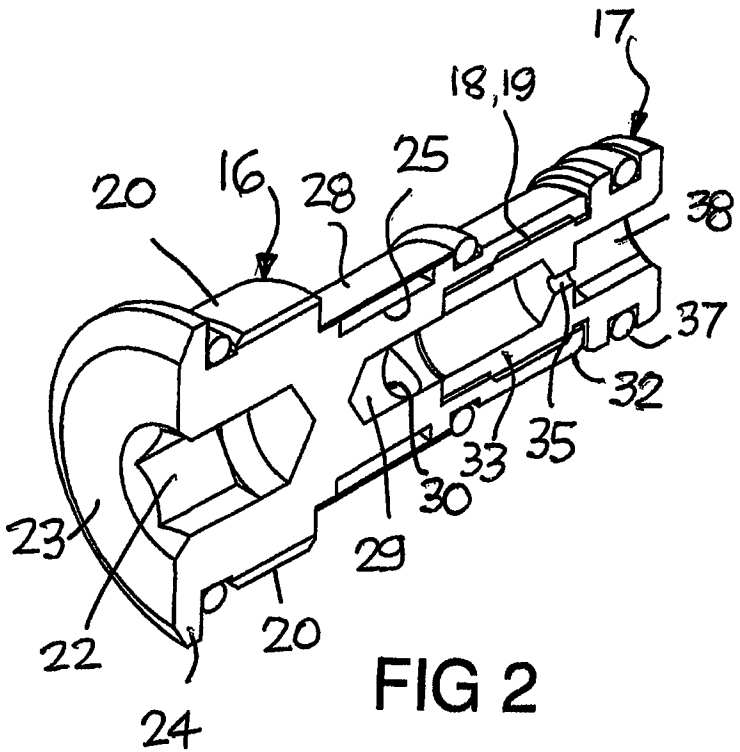
FIG. 2 is a perspective of FIG. 1.
Figure 3:
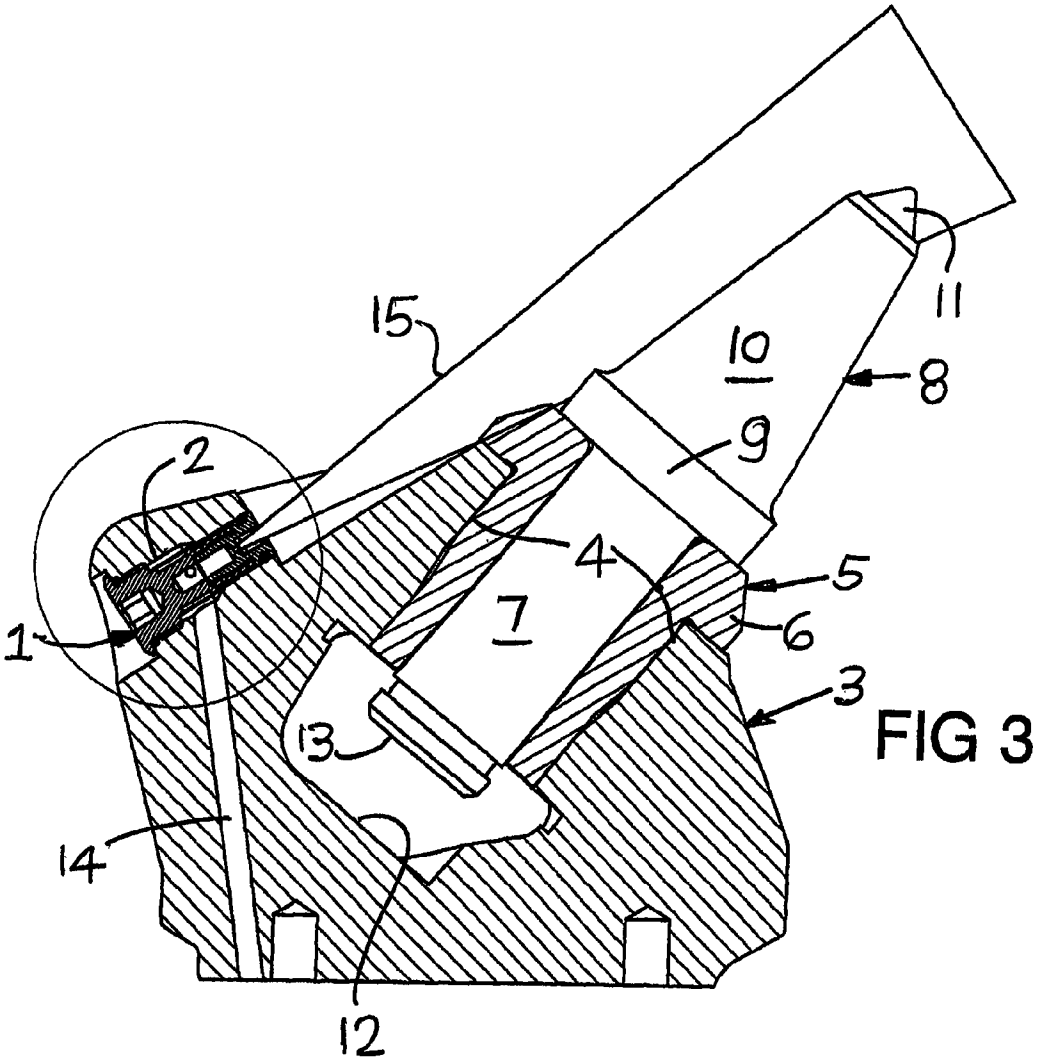
FIG. 3 is a sectional side elevation through a pick box fitted with the water spray assembly of FIGS. 1 and 2, in accordance with the second aspect of the invention.
Figure 4:
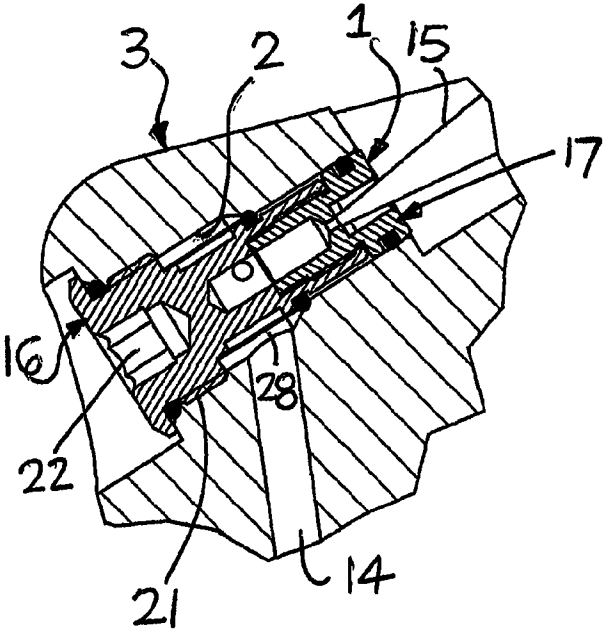
FIG. 4 is an enlargement of the circled portion of FIG. 3.
Figure 5:
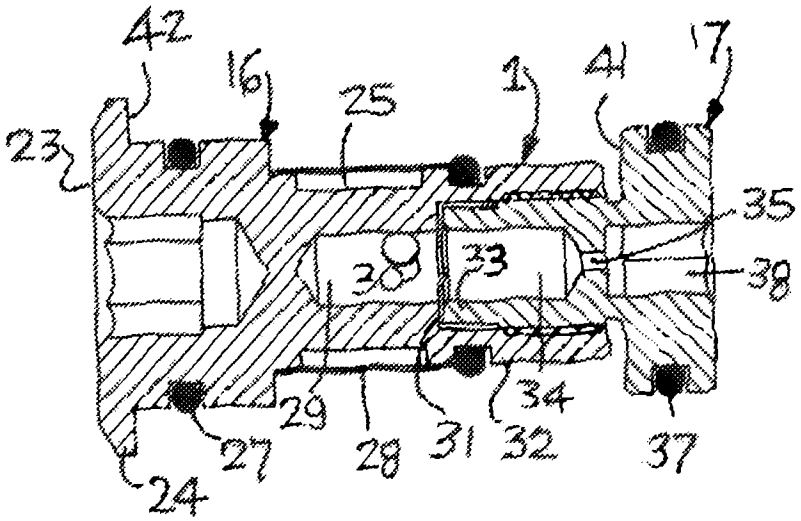
FIGS. 5 and 6 correspond to FIGS. 1 and 2, but show the second embodiment of water spray assembly.
Figure 6:
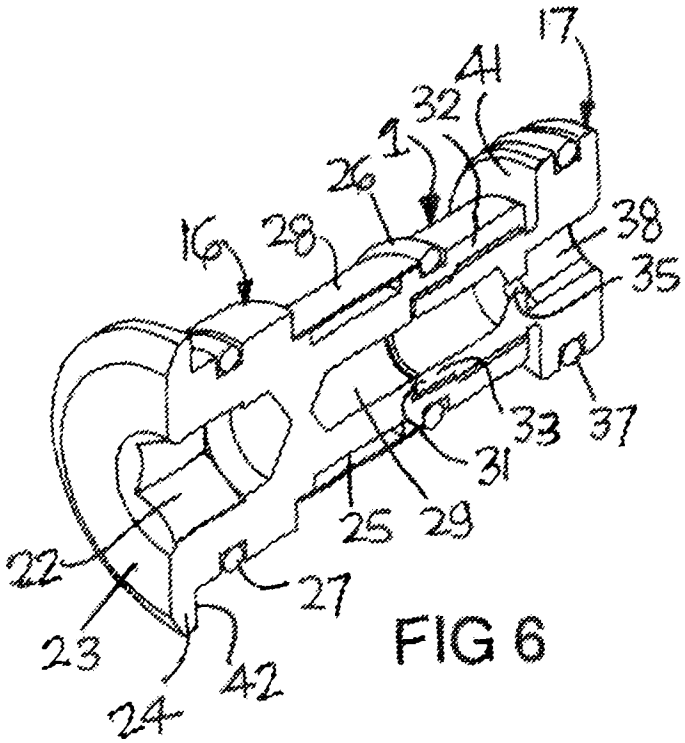
Figure 8:
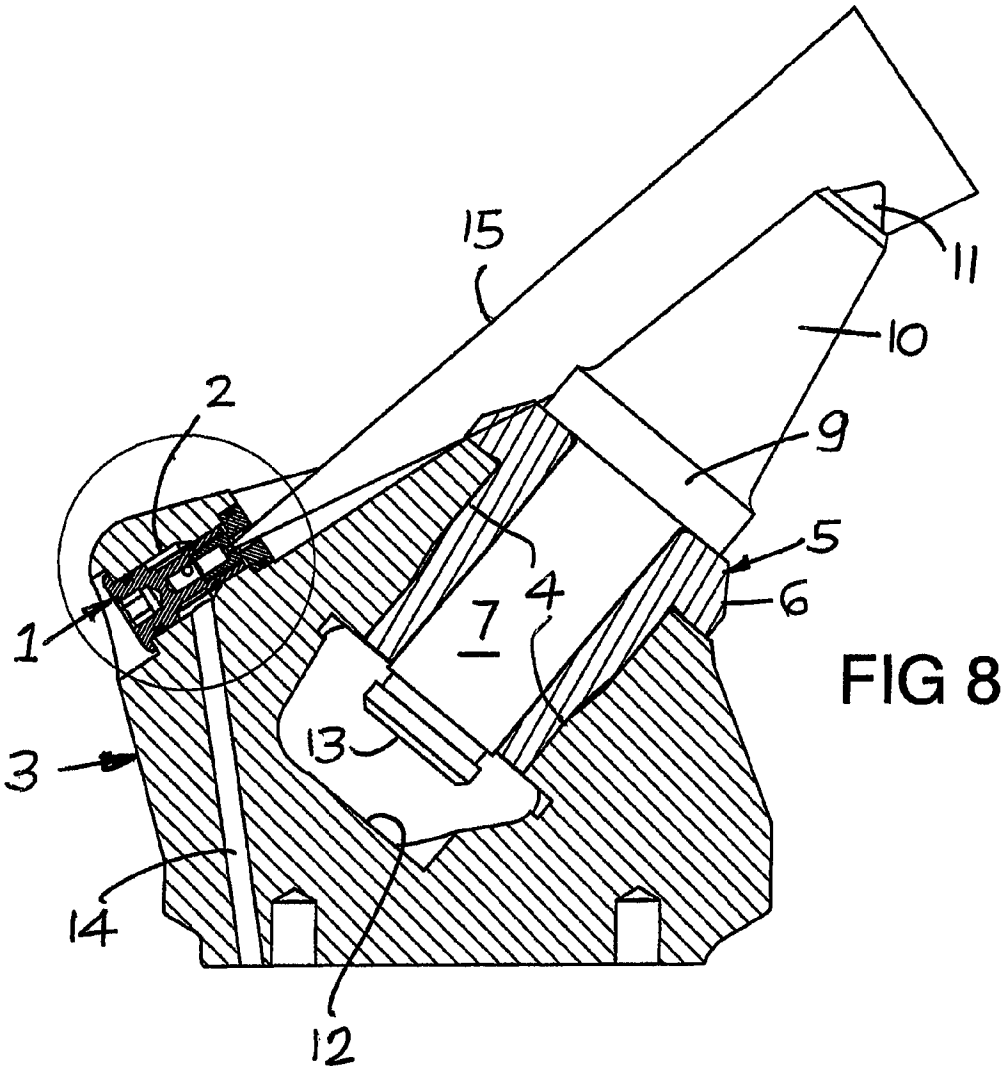
FIGS. 7 and 8 correspond to FIGS. 3 and 4, but show the pick box fitted with the second embodiment of water spray assembly.
Figure 7:
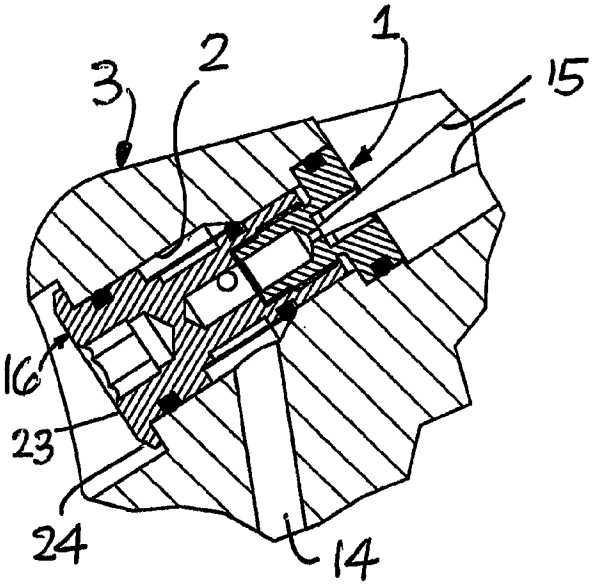
Figures 9, 10, 11, 12, 13, 14:
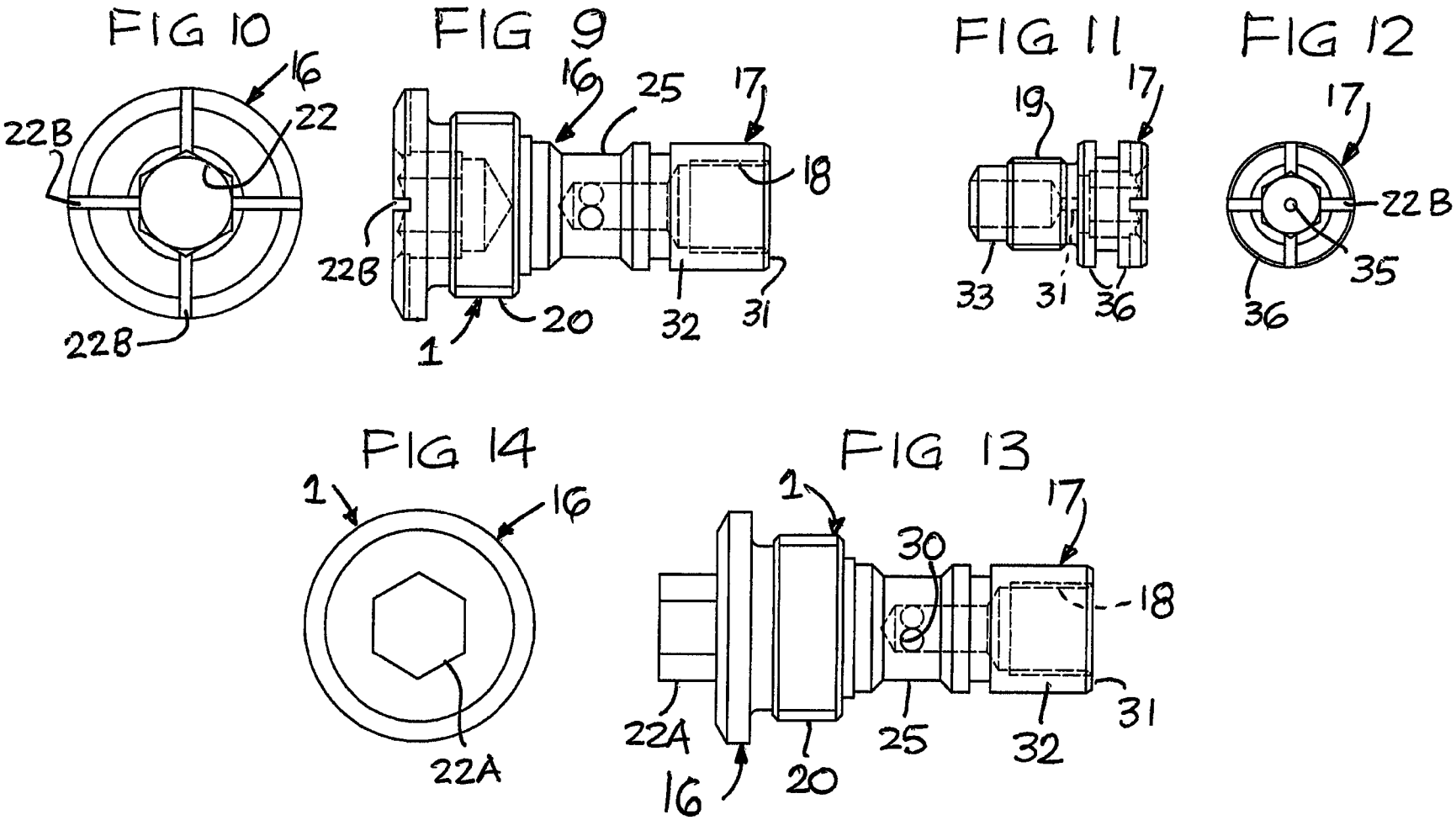
FIGS. 9, 10, 11, and 12 are respectively side and end elevations of the spray body and spray nozzle, respectively of a disassembled, third embodiment of water spray assembly, with sealing rings and gauze filter sleeve omitted for clarity.
FIGS. 13 and 14 are a side elevation and end elevation respectively of a spray body of a fourth embodiment of water spray assembly with sealing rings and gauze filter sleeve omitted for clarity.

In accordance with the invention, and as best seen as the first embodiment of FIGS. 1 and 2, the second embodiment in FIGS. 5 and 6, the third embodiment of FIGS. 9 to 12, and the fourth embodiment of FIGS. 13 and 14.

In all embodiments, like components are accorded like reference numerals.

In all embodiments, the water spray assembly is constructed from two basic components being a spray body 16 and a co-axial spray nozzle 17, with the body 16 being internally threaded at 18 and the nozzle 17 externally threaded at 19, so that the two components may be readily screwed together, or screwed apart e.g. when it is required to remove the nozzle 17 for cleaning, usually for the removal of debris entrained in the mine water supply, whereas the body 16 would normally remain in situ for the life of the pick box 3.

In the embodiments of FIGS. 1 to 4, and 9 to 12 the body 16 is provided with an external thread 20 with a portion of the receiving bore 3 being internally tapped at 21. In the embodiments of FIGS. 1-8 and 9-12 the body 16 is provided with a hexagonal socket 22 for engagement by an Allen key, and in the embodiment of FIGS. 13 and 14 with a hexagonal spigot 22A for engagement by a suitable socket.

The spray body 16 terminates, as an outer end 23, in an enlarged head or collar 24 adapted, in use, to abut a portion of the pick box and thereby limit penetration of the water spray assembly 1 into its receiving bore 2.

The spray body 16 is provided, intermediate its ends, with a circumferential groove 25 adapted to be in water flow communication with the water supply bore 14 of the pick box 3, and is also provided with two resilient water sealing rings 26, 27, one located each side of the circumferential groove, in appropriate receiving grooves, whilst a gauze filter sleeve 28 surrounds the circumferential groove 25. The spray body 16 is additionally provided with an internal, water-receiving chamber 29 in the form of a coaxial bore to which water is conveyed by at least one inlet bore 30 from the circumferential groove 25 which inlet bore 30 is located at such an angle as to produce a swirl in the water supply.

The spray body 16 terminates, at its inner end 31, in a sleeve 32, which is internally threaded at 18, to receive a nose portion 33 of the water spray nozzle 17, which is correspondingly externally threaded at 19.

The water spray nozzle 17 is also provided with a water receiving chamber 34 in the form of a coaxial bore in fluid flow communication with the chamber 29 of the water spray body 16, the chambers 29 and 34 being of the same diameter, whilst water receiving chamber 34 is provided with a discharge orifice 35 appropriate to the conical spray 15, or other water spray pattern required.

The water spray nozzle 17 is also provided at its outer end with an enlarged head or collar 36 which is externally grooved, between its ends, to receive a water sealing ring 37, the head or collar being adapted to enter a portion of the receiving bore 2, with the sealing ring resiliently engaging that portion.

The enlarged head or collar 36 is of smaller diameter than the head or collar 24 of the spray body 16, such that the head or collar may penetrate an end portion, of the receiving bore 2, and hence be protected, as shown in FIGS. 3, 4, 7 and 8.

The enlarged head or collar 36 is also provided with a hexagonal recess 38 to be engaged by an Allen key, to enable the water spray nozzle 17 to make screwed connection with, or disconnection from, the water spray body 16.

In the connected position of the components 16 and 17, a terminal inner end 39 of the spray nozzle 17 abuts an annular, radial face 40 of the spray body 16.

In the embodiment of water spray assembly 1 is shown in FIGS. 5 and 6, adapted to be retained in its receiving bore 2 in a screwless manner, for which purpose the enlarged head or collar 24 of the water spray nozzle 16, together with the enlarged head or collar 36 of the water spray body 17, define abutment surfaces 41 and 42 respectively for location against corresponding surfaces of the pick box 3.

This embodiment avoids the need to tap the receiving bore 2, and simplifies fitting and removal of the water spray assembly 1.

Although the arrangement could be such that both enlarged heads 24 and 36 engage, and can be tightened against, surfaces of the pick box 3, the arrangement is such that the spray assembly 1 can float, within limits, in the receiving bore 2.

The embodiments of FIGS. 9-12 also indicate the possibility of providing diametrical slots 22B to receive an ordinary screwdriver blade. The slots 22B may be in addition to a hexagon socket 22, or an alternative to a hexagon socket 22.

While I have illustrated and described preferred embodiments of my invention, it is understood that these are capable of modification, and I therefore do not wish to be limited to the precise details set forth, but desire to avail myself of such changes and alterations as fall within the purview of the following claims.

I claim:

1. A water spray assembly for replaceable location in a receiving bore, said water spray assembly comprising:

a spray body and a spray nozzle;

the spray body and the spray nozzle being releasably connectable together by screw threads, the spray nozzle being co-axial with the spray body when connected to the spray body;

the spray body comprising opposite ends, an external circumferential groove between the ends, and an internal fluid chamber, the groove in fluid communication with the fluid chamber;

first and second water sealing rings extending around the spray body, the groove being between the first and second rings;

a third water sealing ring extending around the spray nozzle; and each of the first, second, and third rings configured to make sealing contact with a portion of the receiving bore when the water spray assembly is in said receiving bore, whereby the spray nozzle is removable from or insertable into one end of the receiving bore while the spray body is disposed in an opposite end of the receiving bore.

2. The water spray assembly as claimed in claim 1, wherein said spray body is provided with an external thread.

3. The water spray assembly as claimed in claim 2, wherein an end of said spray body distal from the screw thread by which said spray body is connectable to said spray nozzle is provided with a hexagonal socket.

4. The water spray assembly as claimed in claim 2, wherein an end of said spray body distal from the screw thread by which said spray body is connectable to said spray nozzle is provided with a diametrical slot.

5. The water spray assembly as claimed in claim 2, wherein an end of said spray body distal from the screw thread by which said spray body is connectable to said spray nozzle is provided with a hexagonal spigot.

6. The water spray assembly as claimed in claim 1, wherein said spray body terminates, at an end thereof distal from the screw thread by which said spray body is connectable to said spray nozzle, in an enlarged head or collar.

7. The water spray assembly as claimed in claim 1, wherein said spray body is provided with a gauze filter sleeve surrounding said circumferential groove.

8. The water spray assembly as claimed in claim 1, wherein said spray body comprises at least one bore extending from the groove and opening into the fluid chamber.

9. The water spray assembly as claimed in claim 8, wherein said at least one bore is located at such an angle as to produce, when water flows through said at least one bore into the fluid chamber, a swirl in the water in the fluid chamber.

10. The water spray assembly as claimed in claim 1, wherein said spray body terminates, at an end proximate to the screw thread by which said spray body is connectable to said spray nozzle, in a sleeve, which is internally threaded, to receive a nose portion of said spray nozzle, which is correspondingly externally threaded, whereby the spray body and the spray nozzle may be attached to one another or detached from one another.

11. The water spray assembly as claimed in claim 1, wherein said spray nozzle is also provided with a fluid chamber in fluid flow communication with said fluid chamber of said spray body when the spray body and the spray nozzle are connected together, both said fluid chambers being of the same diameter.

12. The water spray assembly as claimed in claim 11, wherein said fluid chamber of said spray nozzle is provided with a discharge orifice defining a water spray pattern.

13. The water spray assembly as claimed in claim 1, wherein said spray nozzle is provided at an end that is distal from the screw thread by which said spray nozzle is connectable to said spray body with an enlarged head or collar which is externally grooved, between its ends, to receive a fourth water sealing ring, whereby when the water spray assembly is in the receiving bore with the fourth water sealing ring in the external groove of the head or collar the fourth sealing ring resiliently engages said receiving bore.

14. The water spray assembly as claimed in claim 13, wherein said enlarged head or collar of said spray nozzle has a first diameter and said enlarged head or collar of said spray body has a second diameter, the first diameter smaller than the second diameter.

15. The water spray assembly as claimed in claim 13, wherein said enlarged head or collar of said spray nozzle is provided with a hexagonal recess.

16. The water spray assembly as claimed in claim 1, wherein the spray nozzle comprises an enlarged head or collar and the spray body comprises an enlarged head or collar.

17. The water spray assembly as claimed in claim 16, wherein the enlarged head or collar of the spray body is spaced a distance from the enlarged head or collar of the spray nozzle when the spray body is connected to the spray nozzle, and said distance can be selectively varied.

18. The water spray assembly as claimed in claim 16 in combination with a pick box having the receiving bore having a length, the water spray assembly in the receiving bore with the spray nozzle connected to the spray body, the enlarged heads or collars of the spray body and the spray nozzle spaced apart from one another a distance greater than the length of the receiving bore such that the spray assembly floats, within limits, in the receiving bore.

19. The water spray assembly as claimed in claim 16, wherein said enlarged head or collar of said spray nozzle has a diameter, and the enlarged head or collar of said spray body has a diameter equal to the diameter of the enlarged head or collar of the spray nozzle.

20. The water spray assembly as claimed in claim 1 in combination with a pick box having the receiving bore having opposite ends, the spray nozzle being disposed in one end of the receiving bore, the spray body being insertable into and removable from the opposite end of the receiving bore to assemble and disassemble said water spray assembly.

21. The water spray assembly as claimed in claim 20 wherein the pick box comprises a fluid channel opening into the receiving bore, the groove of the spray body facing the channel opening when the water spray assembly is assembled and in the receiving bore.

22. An assembly comprising:

a pick box for a rotary cutter head, the pick box comprising a receiving bore, the bore having opposite ends;

a replaceable water spray assembly in the receiving bore, said water spray assembly comprising a spray body and a co-axial spray nozzle, said spray body and said spray nozzle being releasably connected together by screw threads, the spray body comprising opposite ends, an external circumferential groove between the ends, and an internal fluid chamber, the groove in fluid communication with said spray nozzle;

first and second water sealing rings extending around the spray body, the groove being between the first and second rings;

a third water sealing ring extending around the spray nozzle; and each of the first, second, and third rings making sealing contact with a portion of the receiving bore, whereby said spray nozzle is removable from, or insertable into, one end of the receiving bore without removing said spray body in the receiving bore, and said spray body, with or without said spray nozzle in the receiving bore, is removable from, or insertable into, the opposite end of said receiving bore.

* * * * *